US005485994A

United States Patent [19]

Underwood et al.

[11] Patent Number: 5,485,994

[45] Date of Patent: Jan. 23, 1996

[54] BASEBALL TOSSUP DEVICE

[76] Inventors: Alfred E. Underwood; Dolores M. Underwood, both of 2715 Montague Dr., Galesburg, Ill. 61401

[21] Appl. No.: 197,307

[22] Filed: Feb. 16, 1994

[51] Int. Cl.[6] ..... A63B 69/40

[52] U.S. Cl. ..... 273/26 R

[58] Field of Search ..... 273/26 D, 26 A, 273/26 R, 29 A, 182 R, 182 A, 181 F, 181 R, 127 C

[56] References Cited

U.S. PATENT DOCUMENTS

| | | | |
|---|---|---|---|
| 1,637,537 | 8/1927 | Roberts | 273/201 |
| 1,889,813 | 12/1932 | Smith | 273/181 R |
| 2,232,569 | 2/1944 | Johnson | 273/182 R |
| 2,450,206 | 9/1948 | Shouse | 273/201 |
| 3,526,405 | 9/1970 | Morris | 273/181 R |
| 3,545,752 | 12/1970 | Hill | 273/26 R |
| 3,627,319 | 12/1971 | Van Skyhawk | 273/26 R |
| 3,854,300 | 12/1974 | Payne | 273/26 R |
| 5,294,109 | 5/1994 | Meade | 273/26 D |

FOREIGN PATENT DOCUMENTS

| | | | |
|---|---|---|---|
| 2605525 | 4/1988 | France | 273/182 R |
| 1145069 | 11/1959 | Germany | 273/181 R |

*Primary Examiner*—Theatrice Brown

[57] ABSTRACT

This invention relate to a batting practice apparatus wherein a ball toss-up device is positioned remote from a caged target. The ball toss-up device includes a vertically extending cylindrical tube having therein a cylindrical piston for movement along the longitudinal axis thereof. A coil spring is placed between the lower end of the piston and the bottom of the tube for biasing the piston upwards. A pedal arm is extended through a longitudinal slot in the wall of the cylinder and having one end attached to the piston, whereby a player can manually urge the piston downward against the bias of the spring. A releasable latch is provided to hold the piston in the downward position until manually released by a player to cause a ball to be projected into the air to be hit by a player. An inclined trough is provided between the target and the ball toss-up device for automatically guiding balls to the toss-up device after hitting the target.

2 Claims, 1 Drawing Sheet

Fig-1-
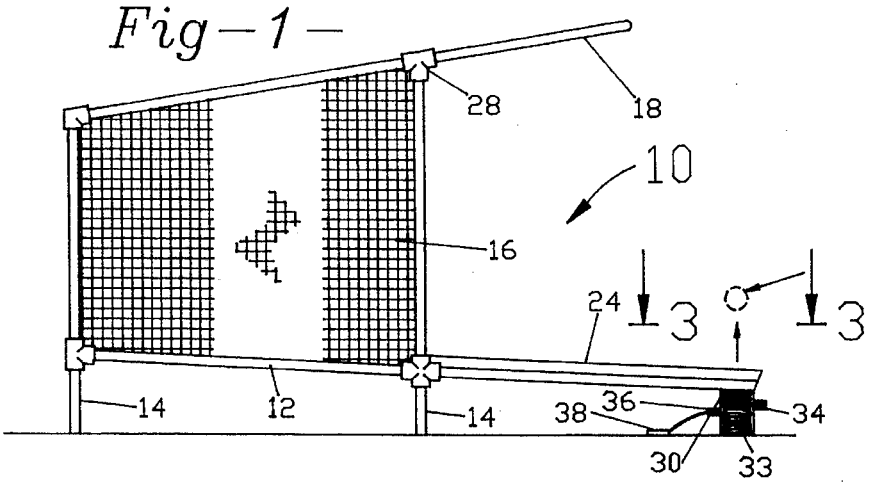
Fig-2-
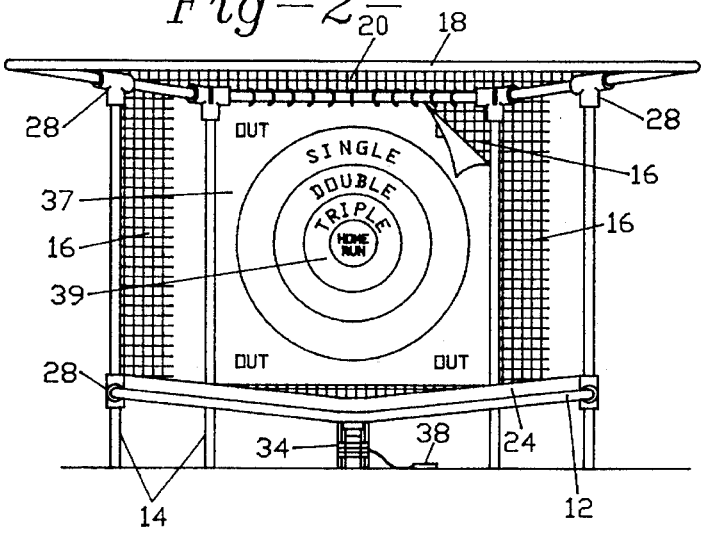
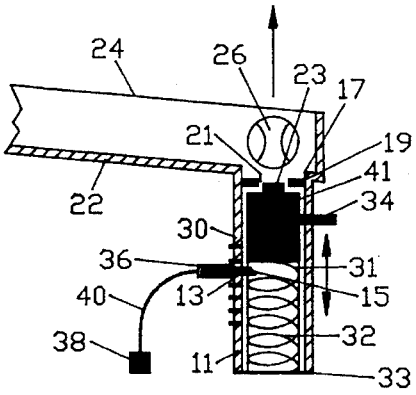
Fig-4-
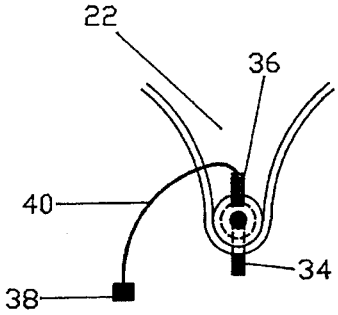
Fig-3-

BASEBALL TOSSUP DEVICE

This invention relates to baseball cage hitting apparatus and more particularly to a practice hitting baseball device for youngsters in the probable age group of 5 years to 12 years.

It is an object of the present invention to provide a baseball device which will have cage means for receiving the ball after it is struck by a person standing in front of the cage, and the cage will have slanted floor means to return the ball by gravity to the vertical projecting unit in front of the batter.

Another object of the present invention is to provide a baseball device which will serve to improve the batter's hand and eye coordination and will be of such construction as to allow a lefthand or righthand batter to control the triggering of the device for the vertical uplift of the ball by a foot pedal means in order that he may hit it with a bat. The unit could also be utilized as a practice device for youngsters just beginning to play "T" ball, without using the projected unit and by placing an adaptable pliable tube in the unit and striking the ball while stationary atop the tube.

A further object of the present invention is to provide a baseball device which will have spring means of projecting with the unit fastened at the front of the cage apparatus and controlled by a pedal for cocking the mechanism and another pedal for triggering the vertical uplift of the ball which in turn is struck by the batter.

Other objects of the invention are to provide a baseball device bearing the above objects in mind which is of simple construction, has a minimum number of parts, is inexpensive to manufacture and efficient in operation and use.

For other objects and for a better understanding of the invention, reference can be made to the following detailed description taken in conjunction with the accompanying drawing, in which:

BRIEF DESCRIPTION OF THE DRAWINGS

FIG. 1 is a side view of the present invention;

FIG. 2 is a front view of FIG. 1;

FIG. 3 is a view taken along the lines 3—3 of FIG. 1; and

FIG. 4 is a fragmentary side view of the invention shown in section.

Referring now more in detail to the drawing, a baseball device 10 made in accordance with the present invention is shown to include a frame 12 made of tubing of suitable material, and a plurality of legs 14 are spaced apart and provide support means for the base frame 12. The cage is defined by a netting 16 is fixedly secured to the upper extremity of legs 14, extending above the base frame 12 a pair of side walls, a rear wall and an oven front. A top frame 18 of suitable tubing over hangs the netting 16. A top netting 20 is fixedly secured within top frame 18. A canvas 22 is stretched and secured as a floor within base frame 12 the floor 22 is configured to slope from the rear wall which cause a ball 26 falling thereon to roll towards the open front. A ball projection unit 30 is positioned a predetermined distance from the open front side of the cage; the rails 12 extend along the edge of floor 22 to guide balls to projector 30. A plurality of connectors 28 are provided for securing top frame 18 and base frame 12 to legs 14. A ball projector 30 is fixedly secured to the floor 22 at a predetermined distance, whereby balls 26 rolling down floor 22 will return to projector 30 by means of gravity. FIG. 4 shows the ball projector unit 30 comprised of a vertically extending cylindrical tube 31 having a piston 41 slidably inserted therein. A coil spring 32 is positioned in the tube 31 between the bottom of piston 41 and a bottom end wall 33 of tube 31, whereby piston 41 is biased upwards. Tube 31 is provided with a plural of vertically spaced apertures 11 intermediate its ends for adjusting the vertical height of a latch 36. The spring biased latch mechanism 36 is removably attached to cylinder 31 and a latch pin 13 extends though an aperture 11 and into the interior of the tube 31. Latch pin 13 has a beveled end 15 which will allow piston 41 to move downward by manual manipulation of pedal 34. Once the upper end of piston 41 is moved downward past end 15 of latch pin 13, spring 36 will force latch pin 13 to move inwards of tube 31 and latch piston 41 in a downward position against the force of spring 32.

Tube 31 has an internal diameter slightly less than the diameter of a regulation baseball 26 such that the ball will come to rest on the upper end rim 17 of tube 31 after rolling down floor 22, by gravity, to ball projector 30.

An annular shoulder 19 is positioned in and attached adjacent the upper end 17 of tube 31 for defining an opening 21.

A ball contact projection 23 is located centrally of the upper end of piston 41. Projection 23 is dimensioned to extend through opening 21 when piston 41 reaches maximum height upon abutting annular shoulder 19.

Latch mechanism 36 can be adjustably positioned in apertures 11 for adjusting the force of which spring 32 exert on piston 41, thus adjusting the height at which a ball 26 will be projected in to the air. A pedal 38 having a Bowden cable 40 is secured to the latch mechanism 36 for withdrawing latch pin 13 to release piston 41 for movement upwards and project ball 26 into the air.

A flexible sheet material 37 having target indicia 39 thereon is attached only at its upper edge to the frame 18 inside of the cage and spaced from the rear wall. The sheet material 37 is placed transversely across the cage whereby it will be impacted by a ball which has been hit from the ball projection area. The ball, after impacting sheet material 37 will fall to floor 22 and roll by gravity to ball projecting unit 30.

In operation, the batter stands alongside of the ball projection unit 30 either to the right or to the left thereof, enabling him to stand even with the ball 26, and when the batter depresses pedal 38 with his foot, it releases latch pin 13 and the spring 32 forces piston upward to project ball 26 vertically upwardly where upon the batter may hit the ball into the caged area of the device 10.

While various changes may be made in the detail construction, it shall be understood that such changes shall be within the spirits and scope of the present invention as defined by the appended claims.

What we claim as new and desire to protect by Letters Patent of the United States is:

1. A batting practice device for tossing a ball vertically into the air, comprising:

A vertically extending tubular member having its lower end resting on a support surface and an upper end; said tubular member having an a plurality of vertically spaced apertures extending through its wall and a longitudinal slot spaced from said apertures and terminating adjacent said upper and lower ends;

a cylindrical piston positioned within said tubular member for longitudinal movement in said tubular member, said piston having a predetermined length less than the length of said tubular member for allowing longitudinal movement in said tubular member;

a coil spring positioned in said tubular member between said support surface and the lower end of said piston for biasing said piston upwards;

pedal means extending through said slot and attached to said piston for a player to manually urging said piston to a downward position against the force of said coil spring;

a spring biased latch means extending through one of said apertures for releasably latching said piston in said downward position against said bias of said spring;

an annular retaining means in said tubular member adjacent said upper end for stopping upward movement of said piston when said piston is released from said latch means;

said tubular member having an inside diameter slightly less than the diameter of a regulation baseball, whereby a baseball may be seated on said upper end of said tubular member;

said piston further having a centrally located projection on the upper end thereof, said projection defining a shoulder for abutting said annular retaining means and a central portion for contacting a ball when said piston is released from said latch means and thrust upwards by said spring; and means remote from said ball tossing device for releasing said latch means from said piston when activated by a batter.

2. The batting practice device as defined in claim 1, further comprising, a caged area for changing the direction;

a batted ball propelled thereagainst said caged area being defined by a frame having a rear wall, right and left side walls, a ceiling, an open front side, and a floor;

said floor being slanted downwards from said rear wall towards said open front side;

rail means extending from said side walls to said ball tossing device for guiding balls from said cage to said ball tossing device;

said cage being covered by a netting material and said floor being a canvis material;

said ball tossing device having a height lower than said floor and being positioned a predetermined distance from said cage and on said front side thereof;

said floor extending said predetermined distance to said ball tossing device, whereby a ball hitting said cage walls will fall to said floor and roll by gravity to said ball tossing device and positioned thereon to be tossed upwards to be hit by a batter; and a target of flexible material extending across said back wall, said target having indicia indicating a triple, double, single, and have run, and an area designated as an "out".

* * * * *